US009903283B1

(12) United States Patent
Rayl, Jr. et al.

(10) Patent No.: US 9,903,283 B1
(45) Date of Patent: Feb. 27, 2018

(54) METHOD TO OPTIMIZE ENGINE OPERATION USING ACTIVE FUEL MANAGEMENT

(71) Applicant: GM Global Technology Operations LLC, Detroit, MI (US)

(72) Inventors: Allen B. Rayl, Jr., Waterford, MI (US); Donovan L. Dibble, Utica, MI (US); Darrell W. Burleigh, Fenton, MI (US); Steven J. Haase, Okemos, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/245,652

(22) Filed: Aug. 24, 2016

(51) Int. Cl.

| | |
|---|---|
| ***F02D 17/02*** | (2006.01) |
| ***F02D 41/14*** | (2006.01) |
| ***F02D 41/26*** | (2006.01) |
| ***F02D 41/00*** | (2006.01) |

(52) U.S. Cl.
CPC ..... *F02D 17/02* (2013.01); *F02D 41/0002* (2013.01); *F02D 41/1406* (2013.01); *F02D 41/26* (2013.01); *F02D 2200/1004* (2013.01); *F02D 2700/02* (2013.01); *F02D 2700/05* (2013.01)

(58) Field of Classification Search
CPC ..... F02D 17/02; F02D 2041/0012; F02D 41/0087; F02D 41/0215; F02D 41/1406; F02D 41/0002; F02D 41/26; F02D 41/0082; F02D 41/182; F02D 2700/02; F02D 2700/05; F02D 2200/0625; F02D 2200/1004; F02D 2250/18; B60W 10/023; B60W 10/06; B60W 10/10; B60W 30/1882
See application file for complete search history.

(56) References Cited

U.S. PATENT DOCUMENTS

| | | | | |
|---|---|---|---|---|
| 9,441,550 | B2 | 9/2016 | Li et al. | |
| 2005/0161023 | A1* | 7/2005 | Albertson | F02D 41/0087 123/399 |
| 2007/0234984 | A1* | 10/2007 | Kolmanovsky | F01L 9/04 123/90.15 |
| 2009/0194064 | A1* | 8/2009 | Wong | F02D 17/02 123/198 F |

(Continued)

*Primary Examiner* — Lindsay Low
*Assistant Examiner* — George Jin

(57) ABSTRACT

A method for operating an internal combustion engine includes providing a vehicle having an internal combustion gasoline engine including multiple cylinders and wherein the engine is capable of running on at least one of a plurality firing fractions, providing a vacuum offset ($Offset_{vac}$) to adjust airflow capacity for each of the plurality of firing fractions, determining a torque capacity of each of the plurality firing fractions and a plurality of available firing fractions that provides at least enough torque capacity to accommodate a current torque requested ($T_{req}$), determining a plurality of viable firing fractions of the plurality of available firing fractions, and determining and implementing an optimal firing fraction of the viable firing fractions if the optimal firing fraction provides enough fuel economy benefit over a current firing fraction.

18 Claims, 5 Drawing Sheets

(56) References Cited

U.S. PATENT DOCUMENTS

| | | | | |
|---|---|---|---|---|
| 2011/0130943 | A1* | 6/2011 | Hysko, Jr. | B60K 26/021 701/103 |
| 2013/0092127 | A1* | 4/2013 | Pirjaberi | F02D 41/0087 123/406.23 |
| 2014/0041625 | A1* | 2/2014 | Pirjaberi | F02D 41/00 123/349 |
| 2014/0041641 | A1* | 2/2014 | Carlson | F02M 25/08 123/520 |
| 2016/0326969 | A1* | 11/2016 | Serrano | F02D 17/02 |

* cited by examiner

METHOD TO OPTIMIZE ENGINE OPERATION USING ACTIVE FUEL MANAGEMENT

FIELD

The invention relates generally to automobile engine control and more particularly to operation of an internal combustion engine while the engine is being run in an active fuel management mode for optimization of fuel efficiency.

BACKGROUND

The statements in this section merely provide background information related to the present disclosure and may or may not constitute prior art.

A typical internal combustion engine is a combination of systems that individually serve a specific function. The air intake system provides throttled air to the engine. The fuels system stores, transports, and regulates fuel flow into the combustion chambers of the engine. The ignition system provides spark for igniting the air/fuel mixture. The power conversion system converts the chemical energy of combustion into work that is transferred to the tires of the vehicle. Other systems perform functions that improve fuel economy and emissions, cool the engine and provide heat to the vehicle cabin, or run other accessories such as power steering or air conditioning.

The size of the engine is typically tailored to the size and purpose of the vehicle. For example, a small light car built for fuel efficiency may include a small three cylinder or four cylinder engine with 1.5 to 2.0 Liters of displacement. Alternatively, a full-size pick-up truck or van that is purposely built for carrying tools and pulling machinery will require an engine having a larger displacement and more cylinders. A displacement of 4.5 L and above in a V8 or V10 configuration provides the torque and power required to carry and pull heavy loads. However, there are occasions of use when such a vehicle will not require all of the torque available in the V8 or V10 engine. It is during such occasions that it becomes desirable from a fuel efficiency standpoint to simply not use all of the cylinders that are available. Thus, a method of operating the engine has been developed to improve fuel economy while maintaining the overall capacity of torque available to the vehicle operator.

Active fuel management methods, or more generally called cylinder deactivation, have been developed which include shutting off fuel delivery to a cylinder when the torque demand on the engine is low. However, there are many issues with controlling an engine and powertrain when using active fuel management. Drivability, torque demand, Noise and Vibration (N&V) must all be maintained or improved while at the same time improving fuel economy. Thus, while current active fuel management controls achieve their intended purpose, the need for new and improved active fuel management controls which ensure the vehicle operators expectations are achieved is essentially constant. Accordingly, there is a need for an improved and reliable active fuel management controls system and method.

SUMMARY

A engine control method is provided comprising providing a vehicle having an internal combustion gasoline engine including multiple cylinders and wherein the engine is capable of running on at least one of a plurality firing fractions, providing a vacuum offset ($Offset_{vac}$) to adjust airflow capacity for each of the plurality of firing fractions, determining a torque capacity of each of the plurality firing fractions and a plurality of available firing fractions that provides at least enough torque capacity to accommodate a current torque requested ($T_{req}$), determining a plurality of viable firing fractions of the plurality of available firing fractions, and determining and implementing an optimal firing fraction of the viable firing fractions if the optimal firing fraction provides enough fuel economy benefit over a current firing fraction.

In one aspect of the present invention, providing a vacuum offset ($Offset_{vac}$) to adjust airflow capacity for each of the firing fractions further comprises increasing $Offset_{vac}$ if an intake manifold vacuum (Vac) is less than a first predetermined threshold for a period of time (T), decreasing $Offset_{vac}$ if an intake manifold vacuum (Vac) is greater than a first predetermined threshold for a period of time (T) and an engine load is high, and maintaining a current $Offset_{vac}$.

In another aspect of the present invention, determining a torque capacity of each firing fraction and a plurality of available firing fractions that has at least enough torque capacity to accommodate a current torque requested $T_{req}$ further comprises determining the net torque capacity ($T_{net}$) of the engine, determining the maximum brake torque ($T_{FF}$) for each firing fraction, and determining a minimum firing fraction that produces at least enough brake torque $T_{FF}$ to accommodate a current torque request $T_{req}$.

In yet another aspect of the present invention, determining the net torque capacity ($T_{net}$) of the engine further comprises determining the $T_{net}$ as a function of engine speed (RPM), maximum torque cam position, barometric pressure, Vac, $Offset_{vac}$, temperature, and humidity.

In yet another aspect of the present invention, determining the maximum brake torque ($T_{FF}$) for each firing fraction further comprises determining $T_{FF}$ by the equation:

$$T_{FF}=T_{net}*FF+T_{friction}$$

wherein $T_{friction}$ is a constant torque loss due to friction losses of the engine.

In yet another aspect of the present invention, determining a plurality of viable firing fractions of the plurality of available firing fractions further comprises determining a new engine speed $EngSpd_{new}$ and a transit engine speed $EngSpd_{transit}$ for one of the plurality of available firing fractions, determining a minimum engine speed $EngSpd_{min}$ of the one of the plurality of available firing fractions, determining finds the maximum engine speed $EngSpd_{max}$ of the one of the plurality of available firing fractions, and wherein $EngSpd_{max}$ is the highest of a current engine speed $EngSpd_{current}$, $EngSpd_{new}$, and $EngSpd_{transit}$, determining a net torque $T_{net}ES_{min}$ and $T_{net}ES_{max}$ for each of $EngSpd_{min}$ and $EngSpd_{max}$, determining a torque limit $T_{limit}$ as the minimum of $T_{net}ES_{min}$ and $T_{net}ES_{max}$, assigning the one of the plurality of available firing fractions as a viable firing fraction if the brake torque limit of the firing fraction $T_{brklim}$ is greater than the requested brake torque $T_{brkreq}$ in addition to the hysteresis and if $T_{limit}$ is greater than a requested net torque $T_{netreq}$ in addition to a hysteresis, and assigning the one of the plurality of available firing fractions as a nonviable firing fraction if the brake torque limit of the firing fraction $T_{brklim}$ is not greater than the requested brake torque $T_{brkreq}$ in addition to the hysteresis or if $T_{limit}$ is not greater than a requested net torque $T_{netreq}$ in addition to the hysteresis.

In yet another aspect of the present invention, determining and implementing an optimal firing fraction of the viable firing fractions if the optimal firing fraction provides enough fuel economy benefit over a current firing fraction further comprises determining the most fuel efficient of the plurality of viable firing fractions $FF_{best}$, determining the fuel efficiency of the current firing fraction $FF_{current}$, determining a ratio of the fuel efficiency Effratio of the most fuel efficient firing fraction $FF_{best}$ to the efficiency of the current firing fraction $FF_{current}$, maintaining the $FF_{current}$ if the Effratio is greater than a first threshold ratio TH1, switching to the $FF_{best}$ if the Effratio is less than a second threshold ratio TH2, maintaining the $FF_{current}$, and determining the most fuel efficient of the plurality of viable firing fractions $FF_{best}$ if the Effratio is less than a first threshold ratio TH1 and greater than a second threshold ratio TH2.

In yet another aspect of the present invention, maintaining the $FF_{current}$ if the Effratio is greater than a first threshold ratio TH1 further comprises maintaining the $FF_{current}$ if the Effratio is greater than 98.5% and switching to the $FF_{best}$ if the Effratio is less than a second threshold ratio TH2 further comprises switching to the $FF_{best}$ if the Effratio is less than 95%.

Further objects, aspects and advantages of the present invention will become apparent by reference to the following description and appended drawings wherein like reference numbers refer to the same component, element or feature.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
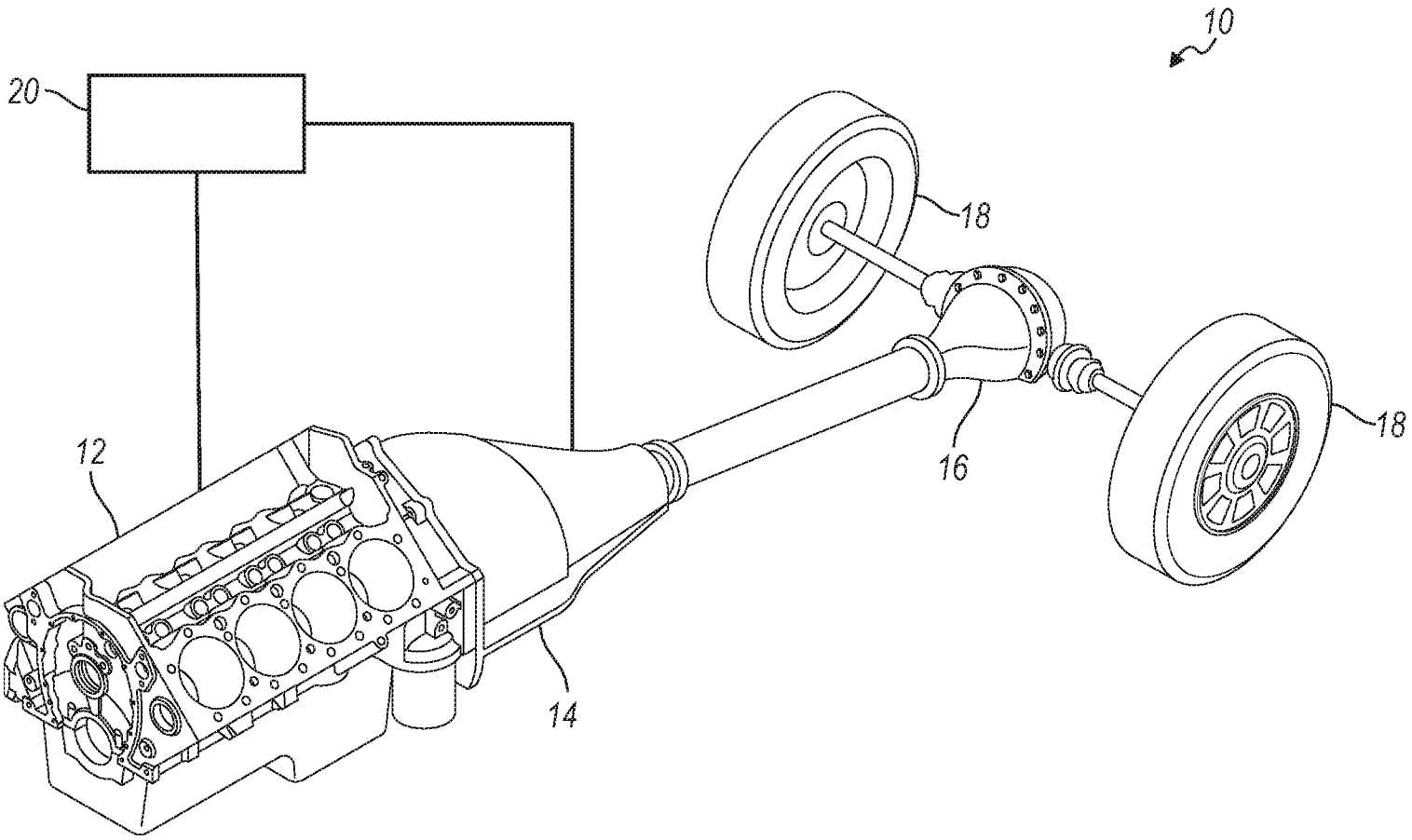
FIG. 1 is a depiction of a powertrain of a vehicle in accordance with an aspect of the present invention.

With reference to FIG. 1, an exemplary powertrain is generally indicated by reference number 10. The powertrain 10 includes an engine 12, a transmission 14, a driveshaft and rear differential 16, drive wheels 18, and a powertrain control module 20. The engine 12 is an internal combustion engine that supplies a driving torque to the transmission 14. Traditionally, an internal combustion engine is identified by the number of cylinders it includes and in what configuration the cylinders are arranged. The engine 12 shown is a V8 configured engine 12 as the engine 12 includes eight cylinders arranged in a "V" configuration. The transmission 14, capable of several forward gear ratios, in turn delivers torque to the driveshaft and rear differential 16 and drive wheels 18.

Figure 2:
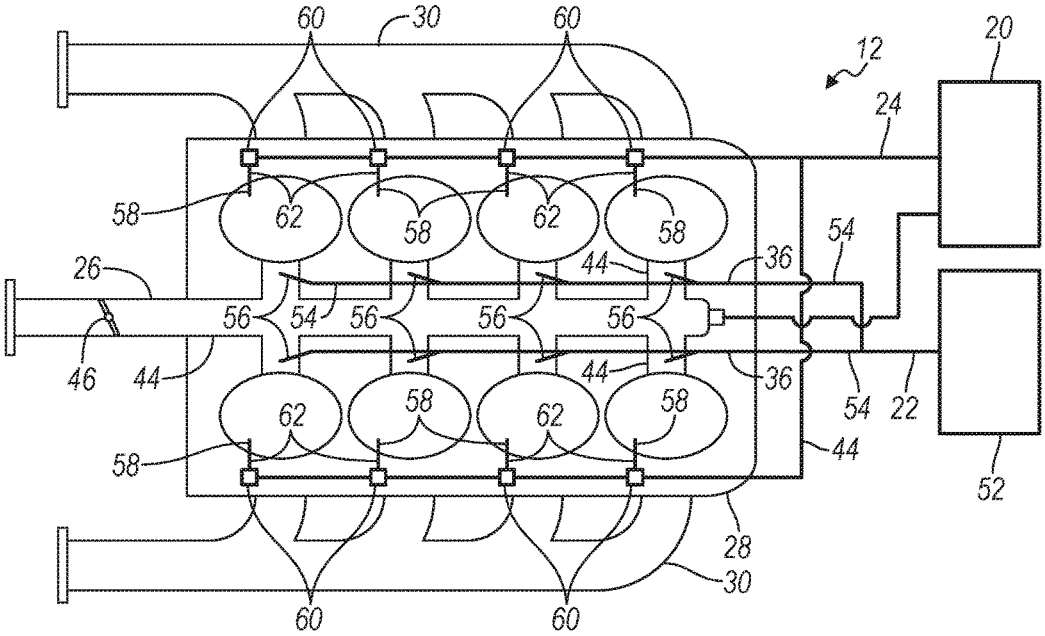
FIG. 2 is a top view schematic of an internal combustion engine, in accordance with an aspect of the present invention.
Figure 3:
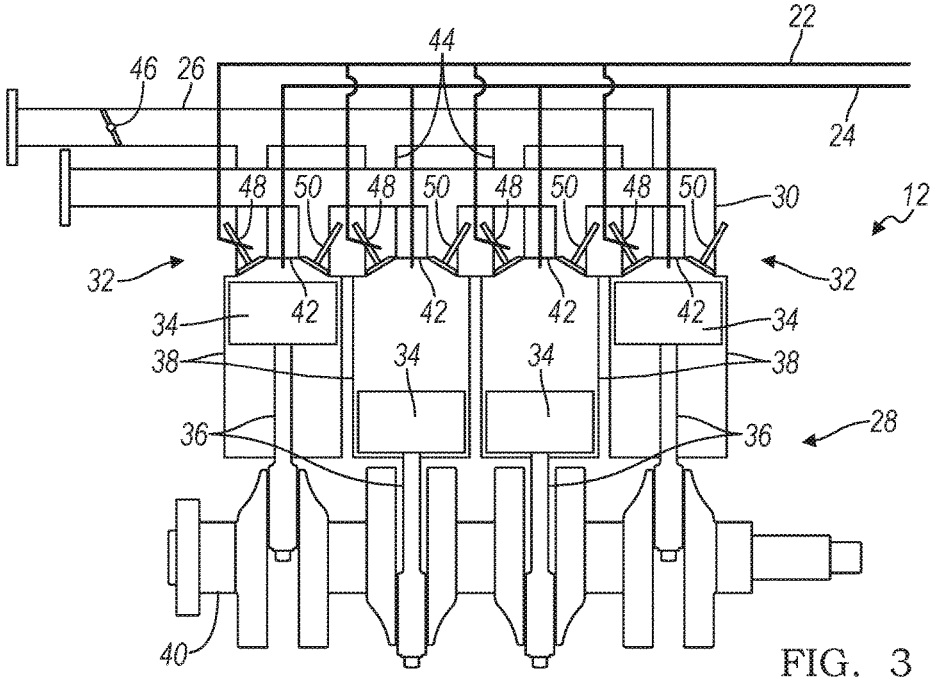
FIG. 3 is a side view schematic of an internal combustion engine, in accordance with an aspect of the present invention.

Turning now to FIGS. 2 and 3, the engine 12 is illustrated and described in greater detail. The engine 12 as a system is a combination of multiple sub-systems operating in a coordinated manner managed by the powertrain control module 20 to convert combustion into mechanical work. For example, the engine 12 may include a fuel delivery system 22, an ignition system 24, an air intake system 26, a power conversion system 28, an exhaust system 30, and a valvetrain system 32, among other subsystems. More particularly, the power conversion system 28 includes a plurality of pistons 34, connecting rods 36, cylinders 38, and a crankshaft 40. Each piston 34 is disposed in one of the cylinders 38 with the piston 34 pinned to an end of a connecting rod 36 with the other end of the connecting rod 36 pinned to an offset journal of the crankshaft 38. The top side of the piston 34 and the cylinder 38 form a combustion chamber 42.

The air intake system 26 includes a plurality of air ducts 44 and a throttle valve 46. The throttle valve 46 controls the amount of airflow passing into the air intake system 26 while the air ducts 44 direct incoming air to be used in the combustion process into the combustion chamber 42.

The valvetrain system 32 includes an intake valve 48 and an exhaust valve 50 in each cylinder 38 and a mechanism (not shown) for actuating the intake valve 46 and exhaust valve 48. The intake valve 48 opens to allow communication between the air ducts 44 of the air intake system 26 and the combustion chamber 42. In the present example, there is only one intake valve 48 and one exhaust valve 50 in each combustion chamber 42. However, valvetrain systems 32 having more than one intake valve 48 or exhaust valve 50 in each cylinder 38 may be considered without departing from the scope of the present invention.

The fuel delivery system 22 includes a pressurized fuel source or fuel pump 52, fuel lines 54, and fuel injectors 56. The fuel pump 52 is disposed in the fuel tank (not shown) located elsewhere in the vehicle. The fuel pump 52 pressurizes the fuel lines 54 which deliver pressurized fuel to the fuel injectors 56. The fuel injectors 56 are disposed in the air ducts 44 of the air intake system 26 proximate the intake valve 48. The fuel injectors 56 may also be located in the combustion chamber 42 wherein the fuel is injected directly into the combustion chamber 42.

The ignition system 24 includes spark plugs 58, ignition coils 60, and ignition wires 62. A single spark plug 58 is disposed in each of the combustion chambers 42. An ignition coil 60 is disposed electrically between the powertrain control module 20 and each of the spark plugs 58. The powertrain control module 20 sends a low voltage electric signal to the ignition coils 60 where the signal is stepped to a high-voltage signal required to create a spark and then sent to the spark plugs 58 through the ignition wires 62. Alternatively, an individual coil can be placed directly on top of each of the spark plugs 58 thus eliminating the high-voltage ignition wires 62.

The exhaust system 30 collects exhaust gases from the combustion process in the combustion chamber 42 and directs the gases through a series of aftertreatment mechanisms such as catalytic converters and mufflers (not shown). Some of the exhaust gases can be diverted back to the intake system for improved combustion and fuel economy.

The powertrain control module 20 is electronically connected to at least the engine 12 and transmission 14 and is preferably an electronic control device having a preprogrammed digital computer or processor, control logic, memory used to store data, and at least one I/O peripheral. The control logic includes a plurality of logic routines for monitoring, manipulating, and generating data. The powertrain control module 20 controls the operation of each of the engine 12 and transmission 14. The control logic may be implemented in hardware, software, or a combination of hardware and software. For example, control logic may be in the form of program code that is stored on the electronic memory storage and executable by the processor. The powertrain control module 20 receives the output signals of several sensors throughout the transmission and engine, performs the control logic and sends command signals to the engine 12 and transmission 14. The engine 12 and transmission 14 receive command signals from the powertrain control module 20 and converts the command signals to control actions operable in the engine 12 and transmission 14. Some of the control actions include but are not limited to increasing engine 12 speed, changing air/fuel ratio, changing transmission 14 gear ratios, etc, among many other control actions.

For example, a control logic implemented in software program code that is executable by the processor of the powertrain control module 20 includes control logic for implementing a method of operating the engine 12 in an active fuel management mode or method 100. The active fuel management method 100 is initiated to improve fuel consumption by cutting off fuel delivery to and deactivating selected cylinders while torque demand on the engine is less than the maximum torque available from the engine. The selected cylinder may change from one crankshaft rotation to the next. In this manner, multiple firing patterns may be developed. The firing pattern is derived from a firing fraction. Each firing fraction has a particular torque capacity associated with that firing fraction and compared to the total torque available from the engine 12. A torque ratio is equivalent to the torque capacity available when the engine 12 is operating at a particular firing fraction divided by the total torque available from the engine 12.

Figure 4:
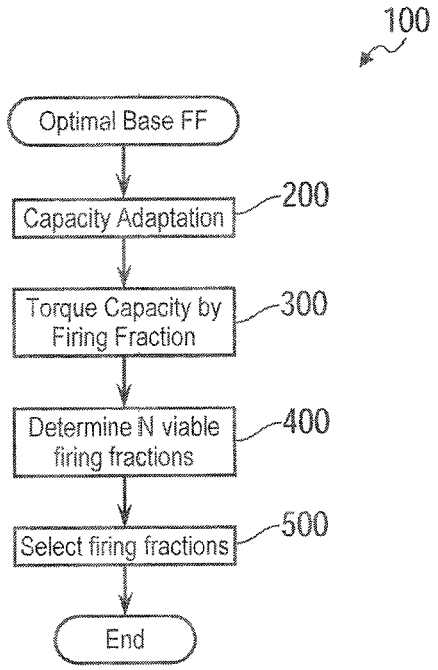
FIG. 4 is a top level flow chart depicting a method of controlling an engine of a vehicle, in accordance with an aspect of the present disclosure.

The active fuel management method 100 control logic, for example, includes a routine having several method steps as shown in FIG. 4 as a flowchart. The several active fuel management method 100 steps each further include a subroutine as part of the active fuel management method 100 and are illustrated in flowchart form in FIGS. 5-7. For example, a first step 200 of the active fuel management method 100 is a first sub-routine for capacity adaptation 210 in which a vacuum offset variable ($Off_{vac}$) is adjusted to change the vacuum request used for engine capacity to accommodate a load. If the capacity of the air intake system is not adjusted then an undesirable situation may occur wherein the engine does not deliver the desired torque. A second step 300 of the active fuel management method 100 is for determining torque capacity by firing fraction and produces a minimum firing fraction that is capable of providing enough torque to accommodate the current torque requested from the engine 12. A third step 400 of the active fuel management method 100 for determining which of the available firing fractions that achieve noise and vibration specifications. A fourth step 500 of the active fuel management method 100 selects the most optimal firing fraction of the viable firing fractions from the third step 400 and determines if the optimal firing fraction provides enough fuel economy benefit over the current firing fraction to make the change to the new optimal firing fraction.

Figure 5:
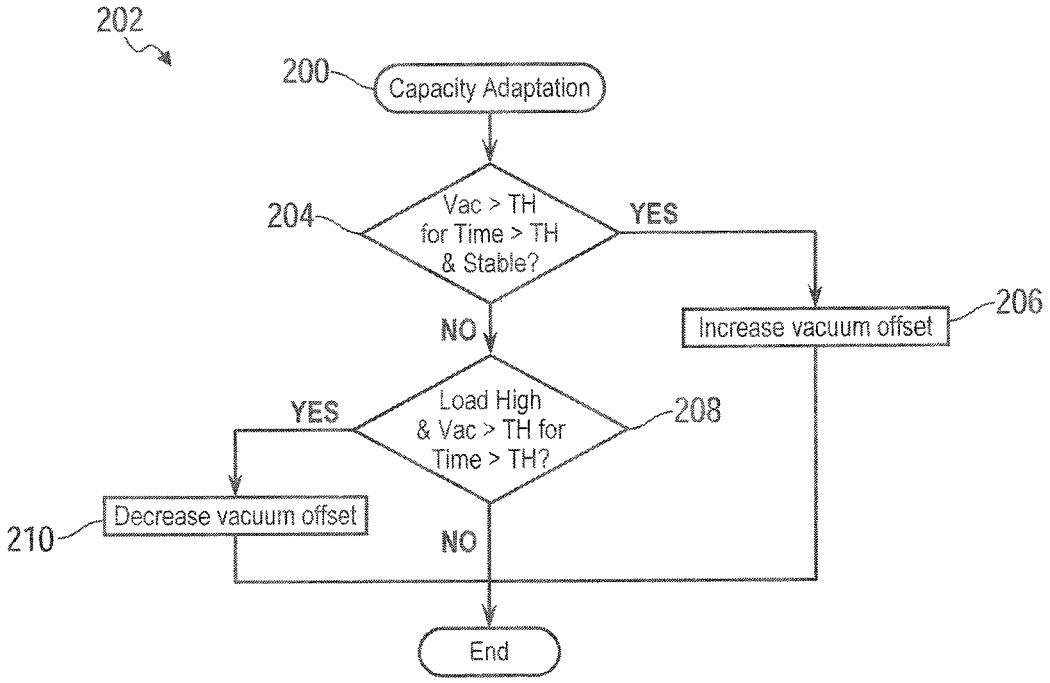
FIG. 5 is a flow chart depicting a sub-routine of controlling an engine of a vehicle, in accordance with an aspect of the present disclosure.

Referring now to FIG. 5, a flow chart depicting a first sub-routine 202 for capacity adaptation for the first step 200 of the active fuel management method 100 for operating an embodiment of the powertrain 10 is illustrated and will now be described. The first sub-routine 202 for capacity adaptation includes a first step 204 for deciding if the intake manifold vacuum (Vac) is less than a first predetermined threshold for a period of time (T) greater than a second predetermined threshold and if the firing fraction is stable or not changing to another firing fraction. If the outcome of the first step 204 is positive, then the first sub-routine for capacity adaptation 202 continues to a second step 206 for increasing $Offset_{vac}$. However, if the outcome of the first step 204 is negative, then the first sub-routine for capacity adaptation 202 continues to a third step 208. The third step 208 of the first sub-routine for capacity adaptation 202 decides if the load on the engine is high and Vac is greater than the first predetermined threshold for a period of time (T) greater than the second predetermined threshold. If the outcome of the third step 208 is positive, then the first sub-routine for capacity adaptation 202 continues to a fourth step 210 of decreasing $Offset_{vac}$. However, if the outcome of the third step 208 is negative, then the first sub-routine for capacity adaptation 202 ends without changing $Offset_{vac}$.

Figure 6:
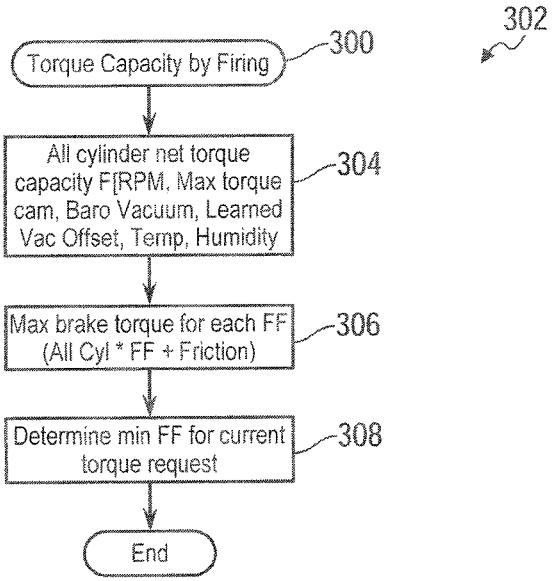
FIG. 6 is a flow chart depicting a sub-routine of controlling an engine of a vehicle, in accordance with an aspect of the present disclosure.

Referring now to FIG. 6, a flow chart depicting a second sub-routine 302 for determining torque capacity by firing fraction for the second step 300 of the active fuel management method 100 for operating an embodiment of the powertrain 10 is illustrated and will now be described. The second sub-routine 302 for determining net torque capacity for all active cylinders by firing fraction includes a first step 304 for finding the engines 12 net torque capacity ($T_{net}$). $T_{net}$ is a function of engine speed (RPM), maximum torque cam position, barometric pressure, Vac, $Off_{vac}$ (from the first sub-routine 202), temperature, and humidity. A combination of inputted variables, calibration tables of coefficients, and imbedded equations is used to arrive at the engine net torque capacity $T_{net}$. A second step 306 finds the maximum brake torque $T_{FF}$ for each firing fraction (FF);

$$T_{FF}=T_{net}*FF+T_{friction}$$

where the $T_{friction}$ is a constant torque loss (thus a negative value) due to the various friction losses in the engine 12. A third step 308 determines the minimum firing fraction $FF_{min}$ that produces at least enough torque $T_{FF}$ to accommodate the current torque request $T_{req}$.

Figure 7:
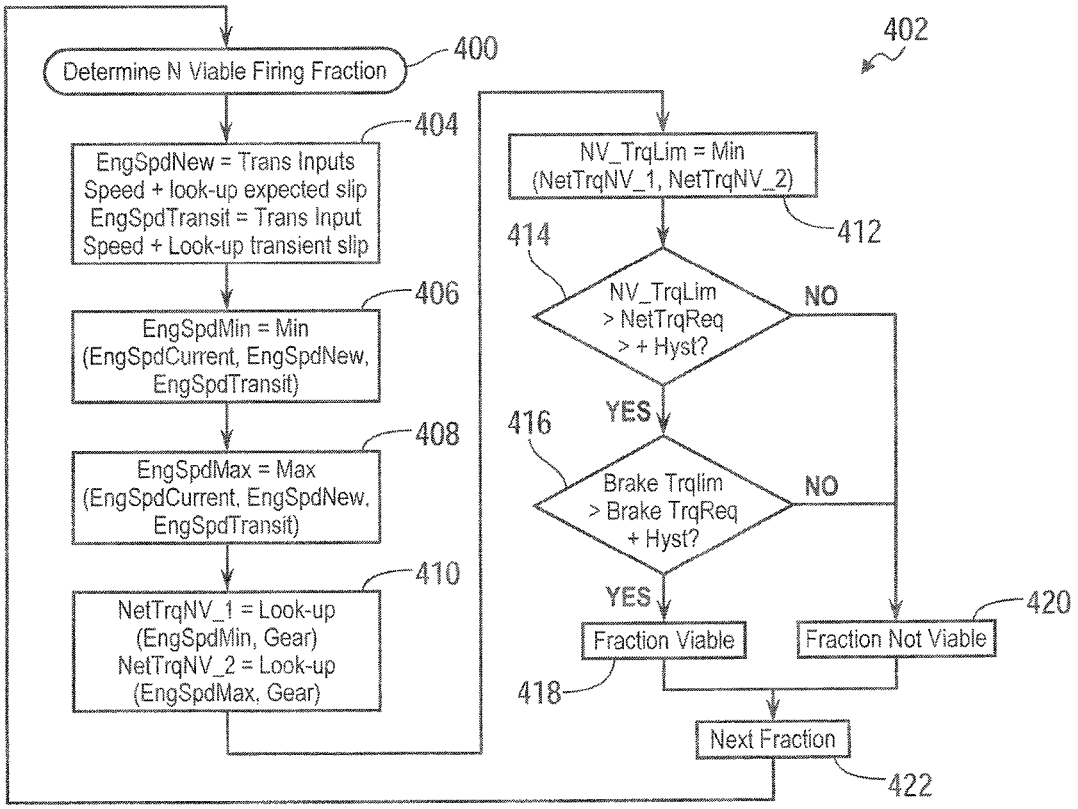
FIG. 7 is a flow chart depicting a sub-routine of controlling an engine of a vehicle, in accordance with an aspect of the present disclosure.

Referring now to FIG. 7, a flow chart depicting a third sub-routine 402 for determining the viable firing fractions for the third step 400 of the active fuel management method 100 for operating an embodiment of the powertrain 10 is illustrated and will now be described. The third sub-routine 402 for determining the viable firing fractions includes a first step 404 for finding a new engine speed $EngSpd_{new}$ and a transit engine speed $EngSpd_{transit}$ for a particular firing fraction that satisfies the minimum torque requirements as determined by the second subroutine 302. $EngSpd_{new}$ is the transmission input speed for a particular torque request and firing fraction in addition to the expected slip from a torque converter of the transmission 14 (from look-up tables). $EngSpd_{transit}$ is the transmission input speed for a particular torque request, firing fraction, and transient slip (from look-up tables). A second step 406 finds the smallest or minimum engine speed $EngSpd_{min}$ of a firing fraction which is the minimum of the current engine speed $EngSpd_{current}$, $EngSpd_{new}$, and $EngSpd_{transit}$. A third step 408 finds the highest or maximum engine speed $EngSpd_{max}$ of a firing fraction which is the highest of the current engine speed $EngSpd_{current}$, $EngSpd_{new}$, and $EngSpd_{transit}$. A fourth step 410 finds the net torque limit that meets noise and vibration requirements for the $EngSpd_{min}$ ($T_{net}ES_{min}$=f(Eng- $Spd_{min}$, transmission 14 gear ratio)) and the net torque for the $EngSpd_{max}$ ($T_{net}ES_{max}$=f($EngSpd_{max}$, transmission 14 gear ratio)) using look-up tables. A fifth step 412 determines the torque limit $T_{limit}$ as the minimum of $T_{net}ES_{min}$ and $T_{net}ES_{max}$. A sixth step 414 determines if $T_{limit}$ is greater than the requested net torque $T_{netreq}$ in addition to a hysteresis. If the sixth step 414 results in the positive, then the seventh step 416 determines if the brake torque limit of the firing fraction $T_{brklim}$ is greater than the requested brake torque $T_{brkreq}$ in addition to the hysteresis. If the seventh step 416 results in the positive, then the firing fraction is flagged as viable in the eighth step 418. If either the sixth step 414 or the seventh step 416 results in the negative, then the firing fraction is flagged as not viable in the ninth step 420. A tenth step 422 restarts the third subroutine 402 for a new firing fraction until a number of viable firing fractions are found to be viable or all firing fractions have been evaluated.

Figure 8:
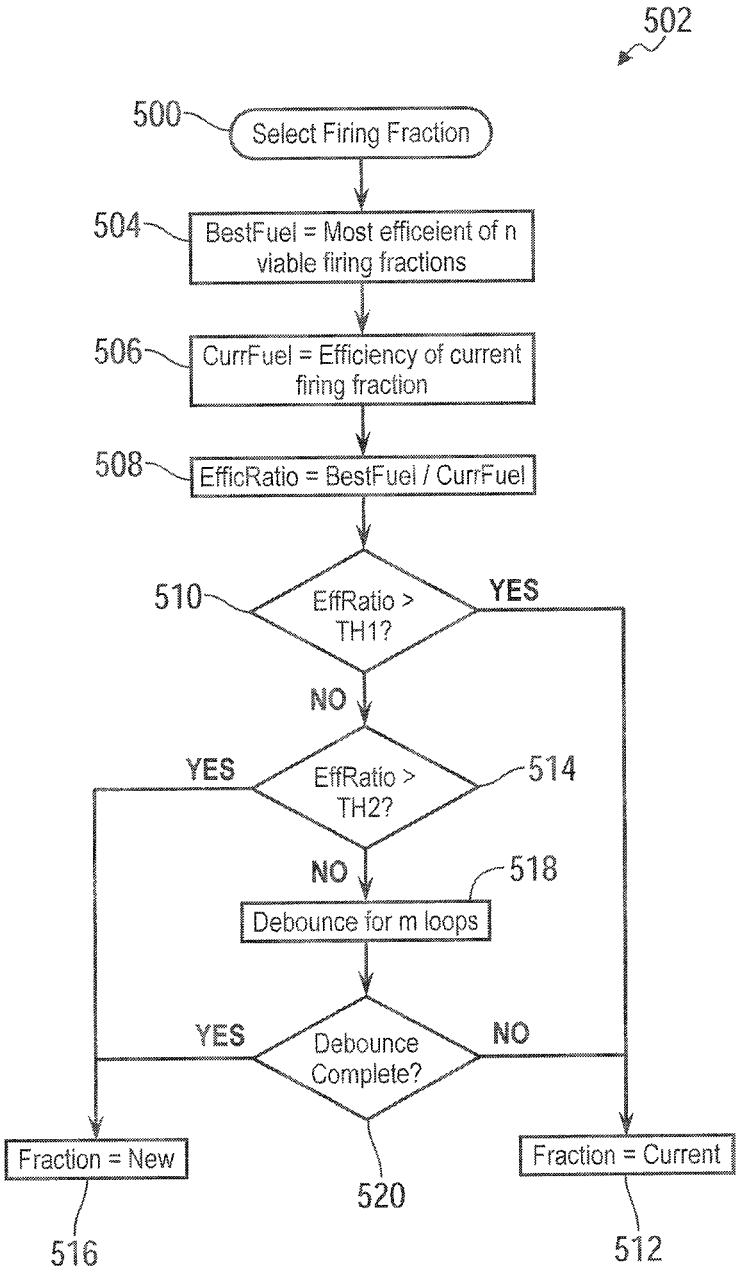
FIG. 8 is a flow chart depicting a sub-routine of controlling an engine of a vehicle, in accordance with an aspect of the present disclosure.

Referring now to FIG. 8, a flow chart depicting a fourth sub-routine 502 for selecting the firing fraction for the fourth step 500 of the active fuel management method 100 for operating an embodiment of the powertrain 10 is illustrated and will now be described. The fourth sub-routine 502 for selecting the firing fraction includes a first step 504 of determining the most fuel efficient of the viable firing fractions $FF_{best}$. The second step 506 determines the fuel efficiency of the current firing fraction $FF_{current}$. The third step 508 determines a ratio of the fuel efficiency Effratio of the most fuel efficient firing fraction $FF_{best}$ to the efficiency of the current firing fraction $FF_{current}$. A forth step 510 determines if the Effratio is greater than a first threshold ratio TH1 (for example TH1=99.5%). If the fourth step results in the positive then the $FF_{best}$ is not sufficiently more efficient and the current firing fraction is kept the same in the fifth step 512. If the fourth step 510 results in the negative then a sixth step 514 is executed. The sixth step 514 determines if the Effratio is less than a second threshold ratio TH2 (for example, TH2=95%). If the sixth step 514 results in the positive then the $FF_{best}$ is sufficiently more efficient and the firing fraction is changed to the most efficient of the viable firing fractions $FF_{best}$ from the first step 504 in step seven 516. If the sixth step 514 results in the negative then an eighth step 518 and a ninth step 520 are executed. The eighth step 518 counts a number N of loops. A ninth step 520 determines if N loops have been completed. If the ninth step 520 results in the positive then step seven 516 changes the firing fraction to the most efficient of the viable firing fractions $FF_{best}$ from the first step 504. If the ninth step 520 results in the negative then step five 512 keeps the firing fraction the same and the fourth subroutine 502 is run again. Rerunning this routine ensures that efficiency improvements are consistent and avoids excessive firing fraction transitions so that changing to the firing fraction with the Effratio that is between the two threshold limits TH1, TH2 will actually benefit the fuel efficiency of the engine 12.

The description of the invention is merely exemplary in nature and variations that do not depart from the gist of the invention are intended to be within the scope of the invention. Such variations are not to be regarded as a departure from the spirit and scope of the invention.

What is claimed is:

1. A method for operating an internal combustion engine, the method comprising:

providing a vehicle having an internal combustion gasoline engine including multiple cylinders and wherein the engine is capable of running on at least one of a plurality of firing fractions;

providing a vacuum offset ($Offset_{vac}$) to adjust airflow capacity for each of the plurality of firing fractions;

determining a torque capacity of each of the plurality of firing fractions and a plurality of available firing fractions that provides at least enough torque capacity to accommodate a current torque requested ($T_{req}$), and wherein determining the torque capacity of each of the plurality of firing fractions comprises:

determining a net torque capacity ($T_{net}$) of the engine;

determining a maximum brake torque ($T_{FF}$) for each firing fraction; and determining a minimum firing fraction that produces at least enough brake torque $T_{FF}$ to accommodate the current torque request $T_{req}$;

determining a plurality of viable firing fractions of the plurality of available firing fractions; and determining and implementing an optimal firing fraction of the viable firing fractions if the optimal firing fraction provides enough fuel economy benefit over a current firing fraction.

2. The method of operating an internal combustion engine of claim 1 wherein providing the vacuum offset ($Offset_{vac}$)) to adjust airflow capacity for each of the firing fractions further comprises:

increasing $Offset_{vac}$ if an intake manifold vacuum (Vac) is less than a first predetermined threshold for a period of time (T);

decreasing $Offset_{vac}$ if an intake manifold vacuum (Vac) is greater than a first predetermined threshold for a period of time (T) and an engine load is high; and maintaining a current $Offset_{vac}$.

3. The method of operating an internal combustion engine of claim 1 wherein determining the net torque capacity ($T_{net}$) of the engine further comprises determining the $T_{net}$ as a function of engine speed (RPM), maximum torque cam position, barometric pressure, Vac, $Offset_{vac}$, temperature, and humidity.

4. The method of operating an internal combustion engine of claim 1 wherein determining the maximum brake torque ($T_{FF}$) for each firing fraction further comprises determining $T_{FF}$ by the equation:

$$T_{FF}=T_{net}*FF+T_{friction}$$

wherein $T_{friction}$ is a constant torque loss due to friction losses of the engine.

5. The method of operating an internal combustion engine of claim 1 wherein determining a plurality of viable firing fractions of the plurality of available firing fractions further comprises:

determining a new engine speed $EngSpd_{new}$ and a transit engine speed $EngSpd_{transit}$ for one of the plurality of available firing fractions;

determining a minimum engine speed $EngSpd_{min}$ of the one of the plurality of available firing fractions;

determining a maximum engine speed $EngSpd_{max}$ of the one of the plurality of available firing fractions, and wherein $EngSpd_{max}$ is the highest of a current engine speed $EngSpd_{current}$, $EngSpd_{new}$, and $EngSpd_{transit}$;

determining a net torque $T_{net}ES_{min}$ and $T_{net}ES_{max}$ for each of $EngSpd_{min}$ and $EngSpd_{max}$;

determining a torque limit $T_{limit}$ as the minimum of $TnetES_{min}$ and $TnetES_{max}$;

assigning the one of the plurality of available firing fractions as a viable firing fraction if a brake torque limit of a firing fraction $T_{brklim}$ is greater than the requested brake torque $T_{brkreq}$ in addition to a hysteresis and if $T_{limit}$ is greater than a requested net torque $T_{netreq}$ in addition to the hysteresis; and assigning the one of the plurality of available firing fractions as a nonviable firing fraction if the brake torque limit of the firing fraction $T_{brklim}$ is not greater than the requested brake torque $T_{brkreq}$ in addition to the hysteresis or if $T_{limit}$ is not greater than a requested net torque $T_{netreq}$ in addition to the hysteresis.

6. The method of operating an internal combustion engine of claim 1 wherein determining and implementing an optimal firing fraction of the viable firing fractions if the optimal firing fraction provides enough fuel economy benefit over a current firing fraction further comprises:

determining a most fuel efficient of the plurality of viable firing fractions $FF_{best}$;

determining a fuel efficiency of the current firing fraction $FF_{current}$;

determines a ratio of a fuel efficiency Effratio of the most fuel efficient firing fraction $FF_{best}$ to the efficiency of the current firing fraction $FF_{current}$;

maintaining the $FF_{current}$ if the Effratio is greater than a first threshold ratio TH1;

switching to the $FF_{best}$ if the Effratio is less than a second threshold ratio TH2;

maintaining the $FF_{current}$ and determining the most fuel efficient of the plurality of viable firing fractions $FF_{best}$ if the Effratio is less than a first threshold ratio TH1 and greater than a second threshold ratio TH2.

7. The method of operating an internal combustion engine of claim 6 wherein maintaining the $FF_{current}$ if the Effratio is greater than a first threshold ratio TH1 further comprises maintaining the $FF_{current}$ if the Effratio is greater than 98.5% and switching to the $FF_{best}$ if the Effratio is less than a second threshold ratio TH2 further comprises switching to the $FF_{best}$ if the Effratio is less than 95%.

8. A method for operating an internal combustion engine, the method comprising:

providing a vehicle having an internal combustion gasoline engine including multiple cylinders and wherein the engine is capable of running on at least one of a plurality firing fractions;

providing a vacuum offset ($Offset_{vac}$) to adjust airflow capacity for each of the plurality of firing fractions providing a vacuum offset ($Offset_{vac}$) to adjust airflow capacity for each of the firing fractions by:

increasing $Offset_{vac}$ if an intake manifold vacuum (Vac) is less than a first predetermined threshold for a period of time (T);

decreasing $Offset_{vac}$ if an intake manifold vacuum (Vac) is greater than a first predetermined threshold for a period of time (T) and an engine load is high; and maintaining a current $Offset_{vac.}$;

determining a torque capacity of each of the plurality firing fractions and a plurality of available firing fractions that provides at least enough torque capacity to accommodate a current torque requested ($T_{req}$) by:

determining the net torque capacity ($T_{net}$) of the engine;

determining the maximum brake torque ($T_{FF}$) for each firing fraction; and determining a minimum firing fraction that produces at least enough brake torque $T_{FF}$ to accommodate a current torque request $T_{req}$;

determining a plurality of viable firing fractions of the plurality of available firing fractions; and determining and implementing an optimal firing fraction of the viable firing fractions if the optimal firing fraction provides enough fuel economy benefit over a current firing fraction.

9. The method of operating an internal combustion engine of claim 8 wherein determining the net torque capacity ($T_{net}$) of the engine further comprises determining the $T_{net}$ as a function of engine speed (RPM), maximum torque cam position, barometric pressure, Vac, $Offset_{vac}$, temperature, and humidity.

10. The method of operating an internal combustion engine of claim 8 wherein determining the maximum brake torque ($T_{FF}$) for each firing fraction further comprises determining $T_{FF}$ by the equation:

$$T_{FF}=T_{net}*FF+T_{friction}$$

wherein $T_{friction}$ is a constant torque loss due to friction losses of the engine.

11. The method of operating an internal combustion engine of claim 8 wherein determining a plurality of viable firing fractions of the plurality of available firing fractions further comprises:

determining a new engine speed $EngSpd_{new}$ and a transit engine speed $EngSpd_{transit}$ for one of the plurality of available firing fractions;

determining a minimum engine speed $EngSpd_{min}$ of the one of the plurality of available firing fractions;

determining finds the maximum engine speed $EngSpd_{max}$ of the one of the plurality of available firing fractions, and wherein $EngSpd_{max}$ is the highest of a current engine speed $EngSpd_{current}$, $EngSpd_{new}$, and $EngSpd_{transit}$;

determining a net torque $T_{net}ES_{min}$ and $T_{net}ES_{max}$ for each of $EngSpd_{min}$ and $EngSpd_{max}$;

determining a torque limit $T_{limit}$ as the minimum of $T_{net}ES_{min}$ and $T_{net}ES_{max}$;

assigning the one of the plurality of available firing fractions as a viable firing fraction if the brake torque limit of the firing fraction $T_{brklim}$ is greater than the requested brake torque $T_{brkreq}$ in addition to the hysteresis and if $T_{limit}$ is greater than a requested net torque $T_{netreq}$ in addition to a hysteresis; and assigning the one of the plurality of available firing fractions as a nonviable firing fraction if the brake torque limit of the firing fraction $T_{brklim}$ is not greater than the requested brake torque $T_{brkreq}$ in addition to the hysteresis or if $T_{limit}$ is not greater than a requested net torque $T_{netreq}$ in addition to the hysteresis.

12. The method of operating an internal combustion engine of claim 8 wherein determining and implementing an optimal firing fraction of the viable firing fractions if the optimal firing fraction provides enough fuel economy benefit over a current firing fraction further comprises:

determining the most fuel efficient of the plurality of viable firing fractions $FF_{best}$;

determining the fuel efficiency of the current firing fraction $FF_{current}$;

determines a ratio of the fuel efficiency Effratio of the most fuel efficient firing fraction $FF_{best}$ to the efficiency of the current firing fraction $FF_{current}$;

maintaining the $FF_{current}$ if the Effratio is greater than a first threshold ratio TH1;

switching to the $FF_{best}$ if the Effratio is less than a second threshold ratio TH2;

maintaining the $FF_{current}$ and determining the most fuel efficient of the plurality of viable firing fractions $FF_{best}$ if the Effratio is less than a first threshold ratio TH1 and greater than a second threshold ratio TH2.

13. The method of operating an internal combustion engine of claim 8 wherein maintaining the $FF_{current}$ if the Effratio is greater than a first threshold ratio TH1 further comprises maintaining the $FF_{current}$ if the Effratio is greater than 98.5% and switching to the $FF_{best}$ if the Effratio is less than a second threshold ratio TH2 further comprises switching to the $FF_{best}$ if the Effratio is less than 95%.

14. A method for operating an internal combustion engine, the method comprising:

providing a vehicle having an internal combustion gasoline engine including multiple cylinders and wherein the engine is capable of running on at least one of a plurality firing fractions;

providing a vacuum offset ($Offset_{vac}$) to adjust airflow capacity for each of the plurality of firing fractions providing a vacuum offset ($Offset_{vac}$) to adjust airflow capacity for each of the firing fractions by:

increasing $Offset_{vac}$ if an intake manifold vacuum (Vac) is less than a first predetermined threshold for a period of time (T);

decreasing $Offset_{vac}$ if an intake manifold vacuum (Vac) is greater than a first predetermined threshold for a period of time (T) and an engine load is high; and maintaining a current $Offset_{vac}$.;

determining a torque capacity of each of the plurality firing fractions and a plurality of available firing fractions that provides at least enough torque capacity to accommodate a current torque requested ($T_{req}$) by:

determining the net torque capacity ($T_{net}$) of the engine;

determining the maximum brake torque ($T_{FF}$) for each firing fraction by the equation:

$$T_{FF}=T_{net}*FF+T_{friction}$$

wherein $T_{friction}$ is a constant torque loss due to friction losses of the engine; and determining a minimum firing fraction that produces at least enough brake torque $T_{FF}$ to accommodate a current torque request $T_{req}$;

determining a plurality of viable firing fractions of the plurality of available firing fractions; and determining and implementing an optimal firing fraction of the viable firing fractions if the optimal firing fraction provides enough fuel economy benefit over a current firing fraction.

15. The method of operating an internal combustion engine of claim 14 wherein determining the net torque capacity ($T_{net}$) of the engine further comprises determining the $T_{net}$ as a function of engine speed (RPM), maximum torque cam position, barometric pressure, Vac, $Offset_{vac}$, temperature, and humidity.

16. The method of operating an internal combustion engine of claim 14 wherein determining a plurality of viable firing fractions of the plurality of available firing fractions further comprises:

determining a new engine speed $EngSpd_{new}$ and a transit engine speed $EngSpd_{transit}$ for one of the plurality of available firing fractions;

determining a minimum engine speed $EngSpd_{min}$ of the one of the plurality of available firing fractions;

determining finds the maximum engine speed $EngSpd_{max}$ of the one of the plurality of available firing fractions, and wherein $EngSpd_{max}$ is the highest of a current engine speed $EngSpd_{current}$, $EngSpd_{new}$, and $EngSpd_{transit}$;

determining a net torque $T_{net}ES_{min}$ and $T_{net}ES_{max}$ for each of $EngSpd_{min}$ and $EngSpd_{max}$;

determining a torque limit $T_{limit}$ as the minimum of $T_{net}ES_{min}$ and $T_{net}ES_{max}$;

assigning the one of the plurality of available firing fractions as a viable firing fraction if the brake torque limit of the firing fraction $T_{brklim}$ is greater than the requested brake torque $T_{brkreq}$ in addition to the hysteresis and if $T_{limit}$ is greater than a requested net torque $T_{netreq}$ in addition to a hysteresis; and assigning the one of the plurality of available firing fractions as a nonviable firing fraction if the brake torque limit of the firing fraction $T_{brklim}$ is not greater than the requested brake torque $T_{brkreq}$ in addition to the hysteresis or if $T_{limit}$ is not greater than a requested net torque $T_{netreq}$ in addition to the hysteresis.

17. The method of operating an internal combustion engine of claim 14 wherein determining and implementing an optimal firing fraction of the viable firing fractions if the optimal firing fraction provides enough fuel economy benefit over a current firing fraction further comprises:

determining the most fuel efficient of the plurality of viable firing fractions $FF_{best}$;

determining the fuel efficiency of the current firing fraction $FF_{current}$;

determines a ratio of the fuel efficiency Effratio of the most fuel efficient firing fraction $FF_{best}$ to the efficiency of the current firing fraction $FF_{current}$;

maintaining the $FF_{current}$ if the Effratio is greater than a first threshold ratio TH1;

switching to the $FF_{best}$ if the Effratio is less than a second threshold ratio TH2;

maintaining the $FF_{current}$ and determining the most fuel efficient of the plurality of viable firing fractions $FF_{best}$ if the Effratio is less than a first threshold ratio TH1 and greater than a second threshold ratio TH2.

18. The method of operating an internal combustion engine of claim 17 wherein maintaining the $FF_{current}$ if the Effratio is greater than a first threshold ratio TH1 further comprises maintaining the $FF_{current}$ if the Effratio is greater than 98.5% and switching to the $FF_{best}$ if the Effratio is less than a second threshold ratio TH2 further comprises switching to the $FF_{best}$ if the Effratio is less than 95%.

* * * * *